US008236393B2

(12) United States Patent
Zeng et al.

(10) Patent No.: US 8,236,393 B2
(45) Date of Patent: Aug. 7, 2012

(54) INKJET RECORDING MATERIAL

(75) Inventors: Xi Zeng, San Diego, CA (US); Jason Swei, San Diego, CA (US); Kali Campbell, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 376 days.

(21) Appl. No.: 12/500,195

(22) Filed: Jul. 9, 2009

(65) Prior Publication Data

US 2011/0008542 A1 Jan. 13, 2011

(51) Int. Cl.
*B41M 5/00* (2006.01)

(52) U.S. Cl. ..... 428/32.21; 428/32.24; 428/32.25; 428/32.34; 427/243; 347/105

(58) Field of Classification Search ..... 428/32.21, 428/32.24, 32.25, 32.34; 427/243; 347/105
See application file for complete search history.

(56) References Cited

U.S. PATENT DOCUMENTS

| | | | | |
|---|---|---|---|---|
| 5,879,442 | A * | 3/1999 | Nishiguchi et al. | 106/464 |
| 5,985,424 | A | 11/1999 | DeMatte et al. | |
| 6,824,844 | B1 | 11/2004 | Kondo et al. | |
| 6,855,382 | B2 | 2/2005 | Barcock et al. | |
| 6,899,930 | B2 | 5/2005 | Kiyama et al. | |
| 7,361,399 | B2 | 4/2008 | Song et al. | |
| 2003/0124272 | A1 | 7/2003 | Watson et al. | |
| 2007/0134450 | A1 | 6/2007 | Campbell et al. | |
| 2007/0218222 | A1 | 9/2007 | Campbell et al. | |
| 2009/0136692 | A1 | 5/2009 | Takahashi et al. | |
| 2010/0092678 | A1 * | 4/2010 | Zeng | 427/288 |

FOREIGN PATENT DOCUMENTS

| | | |
|---|---|---|
| JP | 05-085033 | 4/1993 |
| WO | WO 01/81078 | 11/2001 |

* cited by examiner

*Primary Examiner* — Betelhem Shewareged

(57) ABSTRACT

An inkjet recording material which comprises a supporting substrate, a first bottom base coat applied to at least one surface of said substrate, and a second topcoat layer applied over said base coat. In said inkjet recording material, the base coat includes a combination of at least three pigments and the topcoat layer comprises pigments selected from the group consisting of fumed silica, silica gel, precipitated silica, colloidal silica, fumed alumina, boehmite, pseudo-boehmite or a mixture thereof.

14 Claims, No Drawings

INKJET RECORDING MATERIAL

BACKGROUND

Inkjet technology has expanded its application to high-speed, commercial and industrial printing, in addition to home and office usage. Coated, glossy inkjet recording material (or media) are available for such inkjet printing to produce high gloss prints with high brightness and high image quality comparable to that of off-set printing. It is desirable to make these inkjet recording material low cost so as to enable inkjet printing to be cost-efficient and to compete with traditional analog printing or other digital printing technologies, like laser printing or liquid electrophotography technologies.

Colorants, in inkjet inks, have advanced from dye molecules to pigment particles. Compared to dye-based inks, pigment-based colorants provide much better image performances. For example, light-fade or ozone fade of an image printed with pigment-based inks is much slower than that of an image printed with dye-based inks. With pigment-based inks, water resistance is also significantly improved because dye molecules are more readily dissolved into water than are pigment particles.

Coated inkjet recording materials (or media) have been developed for inkjet technology process, especially, for high-speed printers. In coated inkjet recording material (or media), image-receiving layer (i.e., layer onto which ink droplets are deposited) with small size particles and with high surface area incorporated therein as the major pigment, are often used. Such coating media often give excellent image quality and image permanence. Furthermore, some pigments can provide a coating layer with fast absorption and enough capacity for inkjet printing.

During inkjet printing process, it is often desired for the colorants in inks to be separated quickly after the ink drops are dispatched to recording substrate surface. Colorants are then kept at the substrate surface, while the solvents and other non-colorant components penetrate deeply into the recording substrate and, then, slowly dry through natural evaporation or through a heated drying process. Therefore, it is desirable that inkjet media possess a fast absorption rate to drive the ink vehicle quickly from top surface to the bulk of media, and high capacity to hold a large amount of ink vehicle. Inkjet coated media often use pigments with high surface area in the coating formulation and high coat weight to provide a good absorption rate and capacity. However, with the use of pigment-based inks, image defects and durability problems might be encountered. Such problems may include bad bleeding, coalescence, slow dry time, and poor rubbing or smear resistance. With the inclusion of pigments in the coating lacquers, general image quality and print quality is improved. Often, there are no obvious bleeding, coalescence, roller tracking marks, and other defects. However, images still look very "grainy", i.e., a solid color area is often not uniformly filled and there are many darker color grains throughout the solid area.

DETAILED DESCRIPTION

Embodiments of the present disclosure will employ, unless otherwise indicated, techniques of synthetic organic chemistry, ink chemistry, media chemistry, printing chemistry, and the like, that are within the skill of the art. Such techniques are explained fully in the literature. The following examples are put forth to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere. Unless otherwise indicated, the viscosity is expressed in cps ant is measured at a temperature of 25° C.

Before the embodiments of the present disclosure are described in detail, it is to be understood that, unless otherwise indicated, the present disclosure is not limited to particular materials, and processes disclosed herein as such may vary to some degree. It is also to be understood that the terminology used herein is for purposes of describing particular embodiments only, and is not intended to be limiting, as the scope of the present invention will be defined only by the appended claims and equivalents thereof.

In the present specification, and in the appended claims, the following terminology will be used: the singular forms "a," "an," and "the" include plural referents unless the context clearly dictates otherwise. Thus, for example, reference to "a support" includes a plurality of supports. The terms "about" and "approximately," when referring to a numerical value or range is intended to encompass the values resulting from experimental error that can occur when taking measurements. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to approximately 20 wt % should be interpreted to include not only the explicitly recited concentration limits of 1 wt % to approximately 20 wt %, but also to include individual concentrations such as 2 wt %, 3 wt %, 4 wt %, and sub-ranges such as 5 wt % to 15 wt %, 10 wt % to 20 wt %, etc. As another example, a range of 1 part to 20 parts should be interpreted to include not only the explicitly recited concentration limits of about 1 part to about 20 parts, but also to include individual concentrations such as 2 parts, 3 parts, 4 parts, etc. All parts are dry parts in unit weight, with the sum of the inorganic pigment equal to 100 parts, unless otherwise indicated.

The present disclosure provides inkjet recording material. In an embodiment, such inkjet recording material is glossy inkjet media well adapted for inkjet printing device. The inkjet recording material comprises a supporting substrate and, at least, two ink-receiving layers comprising a first bottom base coat applied to at least one surface of said substrate and a second topcoat layer applied over said base coat. In an embodiment, said first bottom base coat includes a combination of at least three pigments. In another embodiment, the topcoat layer comprises pigments selected from the group consisting of fumed silica, silica gel, precipitated silica, colloidal silica, fumed alumina, boehmite, pseudo-boehmite or a mixture thereof. In an embodiment, the bottom base coat and the topcoat layer are applied to at least one surface of the supporting substrate. In another embodiment, the bottom base coat and the topcoat layer are applied to each surfaces of the supporting substrate. In an embodiment, the inkjet recording material coated with the two ink-receiving layers is used in inkjet printing with pigment-based inks.

Without being bound by the theory, it is believed that such inkjet recording material coated with two ink-receiving layers, when used in inkjet printing with pigment-based inks, imparts good image quality, including reduced print mottling and improved durability performances, especially highlighter smear resistance. Print mottling often presents as uneven, random color patterns in a large area of an image. It is generally believed that uneven absorption of ink vehicle in the coating layer causes this defect, a result of uneven coat weight/thickness on base paper, and/or variation of pore structure in the coating layer. The term "highlighter smear resistance" refers herein to the resistance of a printed image to smearing/blurring when stroked with a highlighter marker.

The inkjet recording material according to the present disclosure, gives good image quality when printed with pigment-based inkjet inks, and greatly improves the "grainy" appearance of images. At the same time, the inkjet recording material, according to the present disclosure, has much lower cost compared to normal inkjet coated media. As "the grainy appearance of images", it is meant herein that the image look "grainy", i.e., a solid color area is not uniformly filled and there are a lot of darker color grains throughout the solid area. Without being limited by the theory, it is believed that the scale of grains is in a smaller scale than coalescence, and may be considered as micro-scale coalescence. In a grainy image, under a microscope, several drops of ink connect to each other and form a secondary structure like a "necklace", while, in non-grainy image, i.e., considered as good image, all the ink drops are evenly distributed in the whole area.

The gloss, including both non-imaged media gloss and image gloss, is comparable to, or higher, than competitive print media products, such as brochure media used in offset printing or electrophotographic printing. At the same time, in order to compete with glossy coated media for traditional analog printing or laser printing, the coated medium of the present disclosure is designed to use low-cost coating materials and can be manufactured at a relatively low cost. Thus, without being bound by the theory, it is believed that the two ink-receiving layers, when applied on inkjet recording material work synergistically with the supporting substrate to provide superior printed images, which mean herein that the image will have an improved gloss and an appearance which is less "grainy".

In an embodiment of the present invention, the inkjet recording material comprises a supporting substrate, a first bottom base coat applied to at least one surface of said substrate, and a second topcoat layer applied over said base coat. In an embodiment, said topcoat layer comprises pigments selected from the group consisting of fumed silica, silica gel, precipitated silica, colloidal silica, fumed alumina, boehmite, pseudo-boehmite or a mixture thereof.

Without being bound by the theory, it is believed that the topcoat layer improves the image appearance of the inkjet recording material when printed with pigment-based inks, i.e., improves the grainy appearance of the image. In an embodiment, the coat weight of this topcoat layer is low enough to get good surface coverage, and, in the same time, this low coat weight is good enough to address the "grainy" appearance in the printed images. Thus, in order to control the cost of the invented inkjet coated media, coat weight of the topcoat is low as long as there is a good surface coverage of topcoat on the final product. Thus, even a thin layer of the topcoat is good enough to address the printed image appearance, i.e., "grainy image", when printed with pigment-based inks.

In an embodiment, the topcoat layer has a coat weight which is in the range of from about 1 and about 10 gram per square meter ($g/m^2$). In another embodiment, the topcoat layer has a coat weight which is in the range of from about 1 to about 5 gram per square meter ($g/m^2$), and, in another embodiment, in the range of from about 2 to about 4 gram per square meter ($g/m^2$).

In an embodiment, the topcoat layer includes a silica type of pigment. In another embodiment, the topcoat layer includes, but is not limited to, fumed silica, silica gel, precipitated silica, colloidal silica, fumed alumina, boehmite, pseudo-boehmite, or a mixture of them. Fumed silica pigment is composed of agglomerates of many non-porous particles of amorphous silica particles with particle size in the nanometer range (e.g., 5 to 20 μm), produced by high temperature hydrolysis of silicon tetrachloride. A silica gel pigment includes porous amorphous silica particles with internal small pores, and is usually manufactured from acid treatment of sodium silicate solution.

In an embodiment of the present invention, the inkjet recording material comprises a supporting substrate, a first bottom base coat applied to at least one surface of said substrate and a second topcoat layer applied over said base coat. In an embodiment, said first bottom base coat includes a combination of at least three pigments.

In an embodiment, bottom base coat has enough coating thickness to provide enough ink capacity for the final product, and it has a fast absorption rate to provide short dry time during printing. Without being bound by the theory, it is believed that the inkjet recording material without the topcoat layer, and with only this bottom base coat layer, presents a fair image quality but presents, when printed with pigmented inks, images that look "grainy".

In an embodiment, the bottom base coat layer of the inkjet recording material has a coat weight which is in the range of from about 10 to about 30 $g/m^2$ (gram per square meter). In another embodiment, the bottom base coat of the inkjet recording material has a coat weight which is in the range of about 15 to about 25 $g/m^2$ (gram per square meter).

In an embodiment of the present invention, the base coat layer includes a combination of at least three pigments. In an embodiment, the base coat is a porous coat layer. In an embodiment, the bottom base coat has a coating formulation including at least three pigments: a first pigment of precipitated calcium carbonate; a second pigment with different particle size and shape than the first pigment, and a third pigment or a pigment mixture with high surface area. For example, in an embodiment, such second pigment is a ground calcium carbonate (GCC) pigment or a clay pigment. For example, in an embodiment, the third pigment is a silica gel pigment or a fumed silica pigment.

In another embodiment of the present invention, the first pigment is precipitated calcium carbonate (PCC), the second pigment is selected from ground calcium carbonate (GCC) or clays, and the third pigment is a silica pigment or a combination of different silica pigments.

In an embodiment, the amount of silica in the bottom base coat is at least 15 parts based on 100 parts of inorganic pigments in total. In one embodiment, the coating composition has a solid content of at least 45% by weight of the bottom layer composition.

In another embodiment of the present invention, the bottom base coat of the inkjet recording material comprises: from about 10 to about 90 weight percent of a first pigment comprising precipitated calcium carbonate particles; from about 5 to about 60 weight percent of a second pigment comprising particles of a liquid absorptive material having a larger size than said first pigment particles and a different shape that of said first pigment particles, and from about 1 to about 50 weight percent of a third pigment comprising particles of a liquid absorptive high surface area material having a surface area of at least 50 $m^2$/gram; said weight percentages are by combined weight of the first, second and third pigments.

In another embodiment of the present invention, the bottom base coat of the inkjet recording material comprises: a first inorganic pigment of precipitated calcium carbonate with an average particle size of less than about 1 μm, a second inorganic pigment with an average particle size greater than that of the first inorganic pigment and selected from the group consisting of ground calcium carbonate (GCC) and clays, a third inorganic pigment of silica with a surface area greater than 100 $m^2$/g, and at least one binder, wherein said silica is present in an amount of at least 15 parts based on 100 parts of inorganic pigments in total.

In an embodiment of the present invention, the first pigment is precipitated calcium carbonate (PCC) particles with a narrow size-distribution. In an embodiment, the PCC particle has an average particle size of less than about 1 micron. In another embodiment, the PCC particle has an average particle size of less than about 400 nm. In an embodiment, the precipitated calcium carbonate is present in an amount ranging from 30 parts to 60 parts based on 100 parts of inorganic pigments in total. Non-limiting example of the first pigment include Opacarb A40™, from Specialty Minerals Inc.

In an embodiment of the present invention, the bottom porous layer includes a second pigment. Without wishing to be limited to any theory, it is believed that inclusion of the second pigment disrupts the packing structure of the first pigment particles in bottom porous layer, creating voids between particles that enhance the flow and storage of liquid. In an embodiment, the second pigment is a GCC pigment, or clay pigment such as silica, kaolin clay, hydrated clay, calcined clay, or other material that is capable of functioning in a similar manner. In an embodiment, the second pigment has a larger particle size and a different shape than the first pigment. In some embodiments, the average particle size of the second pigment is in the range of about 0.5 to about 10 μm. In certain instances, the second pigment's size is in the range of about 0.5 to about 5 μm, and in some cases is about 0.8 to about 2 μm in size.

In another embodiment, the second pigment is a low cost pigment with an average particle size greater than that of the first precipitated calcium carbonate (PCC) pigment and a different particle morphology. In an embodiment, the second pigment is selected from the group consisting of clays, including Kaolin clay, hydrated clay, calcined clay and ground calcium carbonate (GCC). In another embodiment, the second pigment is clay. In another embodiment, the second pigment is present in an amount ranging from about 15 parts to about 35 parts based on 100 parts of inorganic pigments.

In an embodiment, the bottom base coat includes a third pigment. Without wishing to be limited to any theory, it is believed that inclusion of the third pigment further improves liquid penetration in the bottom base coat, especially when it is intended for use in an inkjet digital printing application. In an embodiment, the third pigment has a higher surface area than the first and second pigments; in another embodiment, the third pigment has a surface area of more than about 50 $m^2$ per gram. Suitable materials for the third pigment particles include, but are not limited to, fumed silica, silica gel, colloidal silica, zeolite, and alumina; although any another suitable material capable of functioning similarly to those materials could be used. For example, materials with nano-meter scale structure, such as the calcium carbonate OmyaJet® (Omya Corporation, Alpharetta, Ga.) may serve as the third pigment in some instances. OmyaJet® is a specialty ground calcium carbonate pigment. Its surface has been through special treatment to increase surface area and liquid absorption rate, to a high BET surface area of about 50 $m^2$/g.

In another embodiment, the third pigment is a silica pigment. In another embodiment, the silica, in the base coat of the inkjet recording material, is selected from the group consisting of fumed silica, silica gel, colloidal silica, and precipitated silica.

In another embodiment, the third pigment is a silica pigment with a high surface area. In an embodiment, the second pigment is a silica pigment with a surface area of about 100 $m^2$/gram or higher; in an embodiment, with a surface area of about 200 $m^2$/gram or higher, in another embodiment, with a surface area of about 300 $m^2$/gram or higher. In an embodiment, the third pigment include, but are not limited to, fumed silica, silica gel, colloidal silica, and precipitated silica. In an embodiment, the total amount of silica, in the bottom coating composition, is in the range of about 15 parts to about 60 parts based on 100 parts of inorganic pigments; in another embodiment, is in the range of about 15 parts to about 35 parts.

In one embodiment, a combination of silica powder and silica slurry is used instead silica either in powder or slurry form. Furthermore, the coating composition in this embodiment has a solid content of at least 45 wt %; in an embodiment of at least 50 wt % or higher, and, in an embodiment, a high Hercules viscosity of at least 70 cps at 4400 rpm; in another embodiment, of at least 90 cps.

In one embodiment, the powder silica above may be fumed silica or silica gel. When a combination of silica powder and silica slurry is used, a dry silica powder with a relatively large average particle size and a silica slurry containing silica particles with a relatively smaller average particle size is selected. In an embodiment, the average particle size of silica powder is in the range of about 1 to about 20 μm, and in another embodiment, in the range of about 2 to about 10 μm. In an embodiment, the silica slurry contains particles with average particle size in the range of about 0.05 to about 2 μm; in another embodiment, in the range of about 0.1 to about 1 μm, and in another embodiment, in the range of about 0.2 to about 0.5 microns. In an embodiment, the weight ratio of silica powder to silica slurry may be in the range of from 1:3 to 3:1.

In an embodiment of the present invention, the bottom base coat and topcoat layer formulations include optional ingredients, such as optional polymeric pigment, binders, coating additives and/or rheology modifier and any mixture thereof.

In an embodiment, the bottom base coat and topcoat layer formulations described above may include, as an optional component, a polymeric co-pigment. Suitable polymeric co-pigments include plastic pigments (e.g., polystyrene, polymethacrylates, polyacrylates, copolymers thereof, and/or combinations thereof). Suitable solid spherical plastic pigments are commercially available from The Dow Chemical Company, e.g., DPP 756A or HS 3020. The amount polymeric co-pigment in the coating composition may be in the range of 1 part to 10 parts based on 100 parts of inorganic pigment.

In an embodiment, the bottom base coat and topcoat layer formulations described above may include, one or more binders that may include, but are not limited to, polyvinyl alcohol and derivatives thereof (e.g., carboxylated polyvinyl alcohol, sulfonated polyvinyl alcohol, aceto-acetylated polyvinyl alcohol, and mixtures thereof), polystyrene-butadiene, polyethylene-polyvinyacetate copolymers, starch, gelatin, casein, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl pyrrolidone-vinyl acetate) copolymer, a poly(vinyl acetate-ethylene) copolymer, a poly(vinyl alcohol-ethylene oxide) copolymer, mixtures thereof, and others without restriction. In general, the binder is present in an amount sufficient to bind the inorganic pigments and to meet the requirements of runnability or durability. In an embodiment, the binder is present in an amount ranging from about 5 to 20 parts based on 100 parts of inorganic pigments.

In an embodiment, the bottom base coat and topcoat layer formulations may include other coating additives such as surfactants, rheology modifiers, defoamers, optical brighteners, biocides, pH controlling agents, dyes, and other additives for further enhancing the properties of the coating. The total amount of optional coating additives may be in the range of 0 to 5 parts based on 100 parts of inorganic pigments.

Among these additives, rheology modifier is useful for addressing runnability issues. Suitable rheology modifiers include polycarboxylate-based compounds, polycarboxylated-based alkaline swellable emulsions, or their derivatives. The rheology modifier is helpful for building up the viscosity at certain pH, either at low shear or under high shear, or both. In certain embodiments, a rheology modifier is added to maintain a relatively low viscosity under low shear, and to help build up the viscosity under high shear. It is desirable to provide a coating formulation that is not so viscous during the mixing, pumping and storage stages, but possesses an appropriate viscosity under high shear. Some examples of rheology modifiers that meet this requirement include, but are not limited to, Sterocoll FS (from BASF), Cartocoat RM 12 (from Clariant), Acrysol TT-615 (from Rohm Haas). In an embodiment, the amount of rheology modifier in the coating composition may be in the range of 0.1 to 2 parts, and, in another embodiment, in the range of 0.1 to 0.5 parts.

In an embodiment of the present invention, the inkjet recording material comprises a supporting substrate, a first bottom base coat applied to at least one surface of said substrate, and a second topcoat layer applied over said base coat. The supporting substrate, on which the coating composition is applied, may take the form of a media sheet or a continuous web suitable for use in an inkjet printer. In an embodiment, the supporting substrate may be a base paper manufactured from cellulose fibers. In an embodiment, the base paper may be produced from chemical pulp, mechanical pulp, thermal mechanical pulp and/or the combination of chemical and mechanical pulp. In an embodiment, the base paper may also include conventional additives such as internal sizing agents and fillers. The internal agents are added to the pulp before it is converted into a paper web or substrate. They may be chosen from conventional internal sizing agents for printing papers. In an embodiment, the fillers may be any particular types used in conventional paper making. As a non-limiting example, the fillers may be selected from calcium carbonate, talc, clay, kaolin, titanium dioxide and combinations thereof. Other applicable substrates include cloth, nonwoven fabric, felt, and synthetic (non-cellulosic) papers. In an embodiment, the supporting substrate may be an uncoated raw paper or a pre-coated paper.

In an embodiment, the supporting substrate is paper substrate having a basis weight of from about 100 to about 250 $g/m^2$. In an embodiment, the supporting substrate is a base paper having a regular B size (11"×17") sheet with a basis weight of 90 $g/m^2$, and some typical manufacturers of this kind of paper includes Domtar, Stora Enso, Glatfelter, and International Paper.

In an embodiment, coating compositions described above are applied to one side or to both opposing sides of the supporting substrate. If the coated side is used as an image-receiving side, the other side, i.e., backside, may not have any coating at all, or may be coated with other chemicals (e.g., sizing agents) or coatings to meet certain features such as to balance the curl of the final product or to improve sheet feeding in printer. The double-side coated medium has a sandwich structure, i.e., both sides of the supporting substrate are coated with the same coating and both sides may be printed with images or text.

Both the first bottom base coat and the second topcoat layer, so called coating compositions, are applied to the supporting substrate using any one of a variety of suitable coating methods, such as blade coating, air knife coating, metering rod coating, curtain coating or another suitable technique in view of obtaining the inkjet recording material. To get a low-cost inkjet recording material for inkjet printing, it involves having relatively low manufacturing costs in addition to formulation material costs. Therefore, in an embodiment, low-cost coating method, such as blade coating or metering rod coating are used, and the coating process is run at high speed. For a double-side coated medium, depending on the set-up of production machine in a mill, both sides of the substrate may be coated during a single manufacture pass, or alternatively, each side may be coated in separate passes. The first base coat and the second topcoat layer according to the present disclosure can be applied onto a media substrate (e.g., paper) at high application speeds and has a good runnability as defined by the ability to apply the coating composition onto the media substrate and to obtain a defect-free coated medium with a desired coat weight.

After the coating steps, the coated medium is then subjected to a drying process to remove water and other volatile components in the coating layers and in the substrate. The drying means includes, but not limited to, infrared (IR) dryers, hot surface rolls, and hot air floatation dryers. After coating, the coated medium may be calendered to increase glossiness and/or to impart a satin surface. When a calendering step is incorporated, the coated medium may be calendered by an on-line or an off-line calender machine, which may be a soft-nip calender or a super-calender. The rolls in a calender machine may or may not be heated, and pressure is usually applied to the calendering rolls.

In an embodiment, the present disclosure relates to a method of fabricating an inkjet recording material comprising the steps of preparing a base coat composition comprising a combination of at least three pigments and preparing a topcoat layer composition comprising pigments selected from the group consisting of fumed silica, silica gel, precipitated silica, colloidal silica, fumed alumina, boehmite, pseudo-boehmite or a mixture thereof. Then, in an embodiment, applying the base coating composition to at least one side of a supporting substrate to form a bottom base coat layer, applying the topcoat layer composition over said base coat, and finally, in an embodiment, drying and calendering the coated substrate.

In an embodiment, the coat weight of the topcoat layer has a coat weight which is in the range of about 2 to about 4 gram per square meter ($g/m^2$). In an embodiment, the bottom base coat has a coat weight which is in the range of about 15 to about 30 $g/m^2$.

In an embodiment, the present disclosure relates to a method of enhancing image quality and permanence of an inkjet printed image, comprising the steps of, firstly, obtaining an inkjet recording material comprising a supporting substrate, a first bottom base coat applied to, at least, one surface of said substrate, said base coat including a combination of at least three pigments; and a second topcoat layer applied over said base coat. Said topcoat layer comprises pigments selected from the group consisting of fumed silica, silica gel, precipitated silica, colloidal silica, fumed alumina, boehmite, pseudo-boehmite or a mixture thereof. Then, the method comprises the step of inkjetting a pigmented ink onto the coating layer of said inkjet recording material, to form a printed image; and drying the printed image in view of providing a printed medium with enhanced image quality and enhanced image permanence.

In an embodiment, the inkjet recording material is used with any suitable inkjet printer, and any pigment-based inkjet ink that is ordinarily used for inkjet printing. One such printer is HP 8060 MFP™ with Edgeline™ technology (Hewlett-Packard Corporation).

This combination of coating layers provides a final coating layer with fast liquid penetration, large capacity for receiving and retaining liquid (i.e., ink), and even ink absorption across the inkjet media. When printed with pigment-based inks, embodiments of the inkjet recording material provide good image quality and reduce the grainy appearance of the image.

To further illustrate embodiment(s) of the invention, various examples are given herein. It is to be understood that these are provided for illustrative purposes and are not to be construed as limiting the scope of the disclosed embodiment(s). In the examples below, unless otherwise indicated, all parts are dry parts in unit weight, with the sum of the inorganic pigment equal to 100 parts.

EXAMPLE A

A series of coated paper samples are prepared with coating composition made according to formulas 1 to 7. In all the formulations listed above, chemicals were mixed together in a beaker by using a normal bench stirring equipment and were kept stirring overnight. Each coating liquids were then coated on a base paper stock by using a lab scale single roller blade coater (Euclid Coating Systems Inc) at a coat weight of 20 grams per square meter (g/m$^2$). The base paper was a regular B size (11"×17") sheet with a basis weight of 90 g/m$^2$ (from International Paper). The coated samples were then dried by a normal heat gun. After drying, the coated paper was then calendered using two passes with a lab calender machine under a pressure of 3200 psi, at 130° F. temperature. The samples were then printed on an HP CM8060 MFP printer (Hewlett-Packard Company), and the images were evaluated visually. During the testing process, the standard inks for this printer, i.e., HP C8750A black ink, HP C8751A cyan ink, HP C8752A magenta ink, HP C8753A yellow ink, and HP C8754A bonding agent ink were used. Each sample was ranked against other samples, and then labeled with a relative scale, such as "Good", "Acceptable" and "Bad". Such scale represents the "grainy" evaluation and general resulting appearance of coated paper. Such results are illustrated in table 1.

Coating composition formulas 1 to 7, for coated paper samples, are prepared according to the formulations below. All parts numbers are based on the amount of dry chemicals, with the sum of the inorganic pigment equal to 100 parts.

Formulas 1-4:

Pigment: calcium carbonate or clay, 100 parts.

Binder: Acronal S738,11 parts.

Dispersant: Accumer 9300, 0.2 parts.

Defoamer: Foamaster VF, 0.2 parts.

Surfactant: Olin 10G, 0.3 parts.

Formulas 5-7:

Pigment: silica, 100 parts.

Binder: Mowiol 40-88,12 parts.

Defoamer: Foamaster VF, 0.2 parts.

Surfactant: Olin 10G, 0.3 parts.

TABLE 1

List of coated paper samples and their testing results of the grainy appearance

| Samples | Pigment Name | Pigment Type | Grainy Rating |
|---|---|---|---|
| Formula 1 | Opacarb ® A40 | PCC | Bad |
| Formula 2 | Covercarb ® 85 | GCC | Bad |
| Formula 3 | Ansilex ® 93 | calcined clay | Bad |
| Formula 4 | Covergloss ® | hydrated clay | Acceptable |
| Formula 5 | Ineos Gasil ® 23F | silica gel | Good |
| Formula 6 | Quartron ® PL20 | colloidal silica | Good |
| Formula 7 | Orisil ® 200 | fumed silica | Good |

Opacarb®A40 is precipitated calcium carbonate (PCC) with median particle size of about 400 nm available from Specialty Minerals Inc. IneosGasil®23F is silica gel powder with surface area of 349 m$^2$/g available from PQ Corp. Ansilex®93 is calcined clay with median particle size of 1.7 μm available from BASF Corp. Olin 10G® is poly(2-oxiranemethanol)nonylphenyl ether available from Arch Chemicals. Acronal®S728 is styrene acrylic latex available from BASF Corp. Foamaster®VF is antifoaming agent available from Cognis. Mowiol®40-88 is polyvinyl alcohol available from Clariant. Covercarb®85 is ground calcium carbonate (GCC) available from Omya. Covergloss® is hydrated clay available from KaMin. Quartron®PL20 is colloidal silica made by Fuso Chemical Co. Orisil®200 is fumed silica with surface area of 218 m$^2$/g available from Ltd.

EXAMPLE B

The following are examples of coating formulations of the base coat and topcoat. Formula 8 is a formulation of a bottom base coat, coated at 20 g/m$^2$ on the supporting substrate. Topcoat compositions (formulas 9,10 & 11) were prepared according to the formulations set forth in the following Table 2. Topcoat formulas (9, 10 & 11) are coated on the above mentioned bottom base coat (formula 8) with layer having coat weight of 2 g/m$^2$. In the formulations, parts numbers are used to represent the amount of each material in the final coating lacquers. All parts numbers are based on the amount of dry chemicals, with the sum of the inorganic pigment equal to 100 parts.

Formula 8: Formulation for Bottom Base Coat (Coated at 20 g/m$^2$)

Pigment: Opacarb®A40 (PCC), 50 parts.

Pigment: Ansilex®93 (clay), 30 parts.

Pigment: Gasil®23F (silica gel), 10 parts.

Pigment: Sylojet®A-25 (silica gel), 10 parts.

Binder: Mowiol®40-88, 0.5 parts.

Binder: Acronal®S728, 11 parts.

Defoamer: Foamaster®VF, 0.2 parts.

Surfactant: Olin®10G, 0.3 parts.

Dispersant: Accumer®9300, 0.2 parts.

Rheology modifier: Sterocoll®FS, 0.1 parts.

pH controlling agent: KOH, 0.3 parts.

TABLE 2

Formulations for topcoat examples (coated at 2 g/m$^2$)

| Chemical Name | Function | Formula 9 | Formula 10 | Formula 11 |
|---|---|---|---|---|
| Orisil ® 200 (from Orisil) | pigment | 88.1 parts | — | — |
| Sylojet ® A-25 (from Grace Davison) | pigment | — | 100 parts | — |
| Disperal ® 40 (from Sasol) | pigment | — | — | 100 parts |
| Mowiol ® 15-99 (from Clariant) | binder | 15 parts | 15 parts | 15 parts |
| Tego wet ® 510 (from Evonik) | surfactant | 0.3 parts | 0.3 parts | 0.3 parts |
| Boric acid | cross-linker | 2 parts | 2 parts | 2 parts |
| Lactic acid | treating agent | — | — | 3 parts |
| Foamaster ® VF (from Cognis) | defoamer | — | — | 0.2 parts |
| Locron ® P (from Locron) | treating agent | 4.2 parts | — | — |
| Silquest ® A1100 (from GE) | treating agent | 7.8 parts | — | — |

For each of the coating formulations in the above examples, the components were mixed together in a beaker using a normal bench stirring equipment and the stirring was kept overnight. In some formulations, water may need to be added to obtain the right solid contents. Each coating liquid was then coated onto a base paper by using a laboratory single-roller blade coater (from Euclid Coating Systems Inc.) at a coat weight of 20 g/m$^2$ for the bottom base coat and at a coat weight of 2 g/m$^2$ for the topcoat. The topcoat layer (formulas 9, 10 & 11) is applied over the bottom base coat (formula 8). The base paper is a standard B size (11"×17") uncoated sheet with basis weight of 90 gsm. The coated paper samples were then dried by a normal heat gun. After drying, the coated paper samples were then calendered using two passes with a lab calender machine under a pressure of 3200 psi, at 130° F. temperature. The gloss level of the final sheets was measured using a "Micro gloss 75°", a gloss meter from BYK-Gardner.

The paper samples were then printed on an HP CM8060 MFP with Edgeline technology (from Hewlett-Packard Corporation). Standard pigment inks for this printer were used, i.e., HP C8750A black ink, HP C8751A cyan ink, HP C8752A magenta ink, HP C8753A yellow ink, and HP C8754A bonding agent ink. After printing, the image quality of the prints, including bleeding, coalescence, area color fill, and print mottle, was evaluated visually. Color gamut and black optical density (KOD) were also measured using an X-Rite transmission/reflection densitometer. Smear resistance is measured in milli optical density (milli OD) and measures the smeared portion of the image outside of the originally printed sample image. A higher value of mOD means more ink is smeared off. Thus, a lower value of mOD indicates improved smear fastness. The printed paper sheets were tested for smear resistance by using a Faber-Castell highlighter pen at 24 hours after printing. Using the X-Rite densitometer, the optical density (OD) in the blank areas adjacent to the printed image was measured to determine the amount of ink being transferred from the printed image to the blank (unprinted) areas by the highlighter pens.

The printed samples were evaluated visually, including bleeding, coalescence, area color fill, print mottle, as well as "grainy" image appearance. As mentioned above, each sample was ranked against other samples, and then labeled with a relative scale, such as "Good", "Acceptable" and "Bad" which evaluated whether or not the printed image has a grainy appearance. Table 3 lists the measured data of sheet gloss, color gamut, KOD, mOD from highlighter smear testing, and the visual rating of image graininess.

TABLE 3

Testing data of inkjet coated samples

| Sample ID | Sheet Gloss (75°) | Color Gamut | KOD | High-lighter Smear (mOD), 1 pass, 24 hours | High-lighter Smear (mOD), 2 passes, 24 hours | Grainy Rating |
|---|---|---|---|---|---|---|
| Formula 8 | 55.9 | 376K | 2.20 | 62 | 104 | Bad |
| Formula 9 | 48.0 | 450K | 2.19 | 30 | 239 | Good |
| Formula 10 | 47.2 | 448K | 2.19 | 27 | 223 | Good |
| Formula 11 | 58.4 | 455K | 2.19 | 49 | 175 | Good |

As shown in Table 3, the inkjet recording material with both coating structures (bottom coat and top coat) significantly improve appearances of printed images. Such images have a better appearance than control sample (Formula 8) and are not "grainy" anymore. Furthermore, the presence of the topcoat layers increase the color gamut of the printed images compared to the control samples. Thus, topcoat layers lead to images that possess good image quality and print quality.

The preceding description has been presented only to illustrate and describe exemplary embodiments of the present invention. It is not intended to be exhaustive or to limit the system and method to any precise form disclosed. Many modifications and variations are possible in light of the above teaching. It is intended that the scope of the invention be defined by the following claims.

The invention claimed is:

1. An inkjet recording material, comprising:

a. a supporting substrate;

b. a bottom base coat applied to at least one surface of said substrate, said base coat including a combination of at least three types of pigments; and c. a topcoat layer applied over said base coat, said topcoat layer comprising pigments selected from the group consisting of fumed silica, silica gel, precipitated silica, colloidal silica, fumed alumina, boehmite, pseudo-boehmite, or a mixture thereof.

2. The ink-jet recording material according to claim 1 wherein the topcoat layer has a coat weight which is in the range of about 1 to about 10 gram per square meter (g/m$^2$).

3. The ink-jet recording material according to claim 1 wherein the topcoat layer has a coat weight which is in the range of about 2 to about 4 gram per square meter (g/m$^2$).

4. The ink-jet recording material according to claim 1 wherein the bottom base coat has a coat weight which is in the range of about 10 to about 30 gram per square meter (g/m$^2$).

5. The ink-jet recording material according to claim 1 wherein the bottom base coat has a coat weight which is in the range of about 15 to about 25 gram per square meter ($g/m^2$).

6. The ink-jet recording material according to claim 1 wherein the bottom base coat is a porous coat layer.

7. The ink-jet recording material according to claim 1 wherein the bottom base coat and the topcoat layer are applied to each surfaces of the supporting substrate.

8. The ink-jet recording material according to claim 1 wherein the supporting substrate is paper substrate having a basis weight of from about 100 to about 250 $g/m^2$.

9. The ink-jet recording material according to claim 1 wherein the bottom base coat has a coating formulation including the at least three types of pigments: a first pigment of precipitated calcium carbonate; a second pigment with different particle size and shape than the first pigment; and a third pigment or a pigment mixture with high surface area.

10. The ink-jet recording material according to claim 1 wherein the bottom base coat has a coating formulation including the at least three types of pigments, wherein the first pigment is precipitated calcium carbonate (PCC), wherein the second pigment is selected from ground calcium carbonate (GCC) or clays, and wherein the third pigment is a silica pigment or a combination of different silica pigments.

11. The ink-jet recording material according to claim 1 wherein the bottom base coat has an amount of silica which is at least 15 parts based on 100 parts of inorganic pigments in total.

12. A method of fabricating an inkjet recording material comprising the steps of:

a. preparing an aqueous base coat composition comprising a combination of at least three types of pigments and a topcoat layer composition comprising pigments selected from the group consisting of fumed silica, silica gel, precipitated silica, colloidal silica, fumed alumina, boehmite, pseudo-boehmite or a mixture thereof;

b. applying the base coat composition to at least one side of a supporting substrate to form a bottom base coat layer;

c. applying the topcoat layer composition over said base coat; and d. drying and calendering the coated substrate.

13. The method of claim 12, wherein said the coat weight of the topcoat layer has a coat weight which is in the range of about 2 to about 4 gram per square meter ($g/m^2$) and wherein the bottom base coat has a coat weight which is in the range of about 15 to about 25 $g/m^2$.

14. A method of enhancing image quality and permanence of an inkjet printed image, comprising the steps of:

a. obtaining the inkjet recording material of claim 1;

b. inkjetting a pigmented ink onto the coating layer of said inkjet recording material, to form a printed image; and c. drying the printed image, to provide a printed medium with enhanced image quality and enhanced image permanence.

* * * * *